US005497990A

United States Patent [19]

Nanni

[11] Patent Number: 5,497,990

[45] Date of Patent: Mar. 12, 1996

[54] METHOD FOR PLAYING A LOTTERY GAME USING CURRENCY BILLS

[76] Inventor: Liborio F. Nanni, 5707 Emerald Ridge Blvd., Lakeland, Fla. 33813-3296

[21] Appl. No.: 334,044

[22] Filed: Nov. 4, 1994

[51] Int. Cl.[6] ..... A63B 71/00

[52] U.S. Cl. ..... 273/138 A; 273/139; 364/410

[58] Field of Search ..... 273/138 A, 139, 273/148 R, 269; 364/410, 412; 283/903

[56] References Cited

U.S. PATENT DOCUMENTS 4,993,714 2/1991 Golightly ..... 273/138 A
5,007,641 4/1991 Seidman ..... 273/138 A

*Primary Examiner*—William M. Pierce
*Attorney, Agent, or Firm*—George A. Bode; Daniel E. Maddus

[57] ABSTRACT

A method of playing a lottery game comprising inserting a currency bill or bank note bearing an alphanumeric code, such as a serial number, and denomination into a machine. The machine reads the alphanumeric code and denomination of the currency bill or bank note and stores the information as a set of numbers. The machine then prints a receipt bearing the alphanumeric code and denomination of the currency bill or bank note inserted into the machine and the day of drawing in the lottery game. The set of numbers is then transferred from the machine to a central or main computer's memory. The computer then randomly selects a set of numbers from the transferred set of numbers. The set of numbers chosen is the winning set of lottery numbers. In a preferred embodiment of the method, the central computer stores the number of times the currency bill or bank note has been inserted into any machine, along with the alphanumeric code and denomination of the currency bill or bank note, as a set of numbers. In the most preferred embodiment of the method, the central computer stores the number of times the currency bill or bank note has been inserted into any machine, along with the alphanumeric code and denomination of the currency bill or bank note, as a set of numbers and letters.

9 Claims, 1 Drawing Sheet

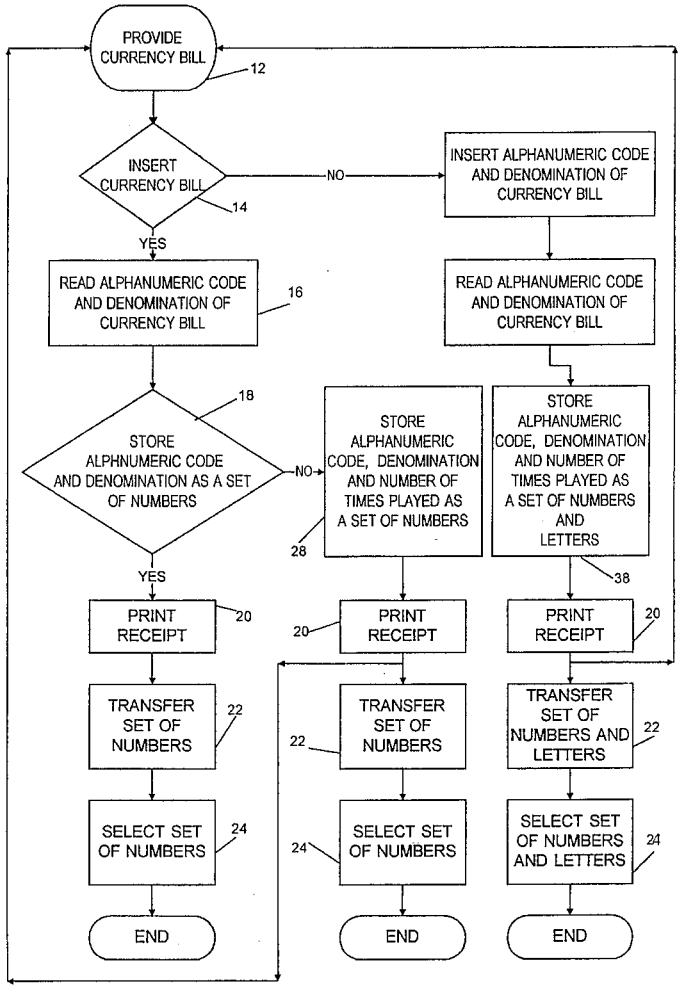

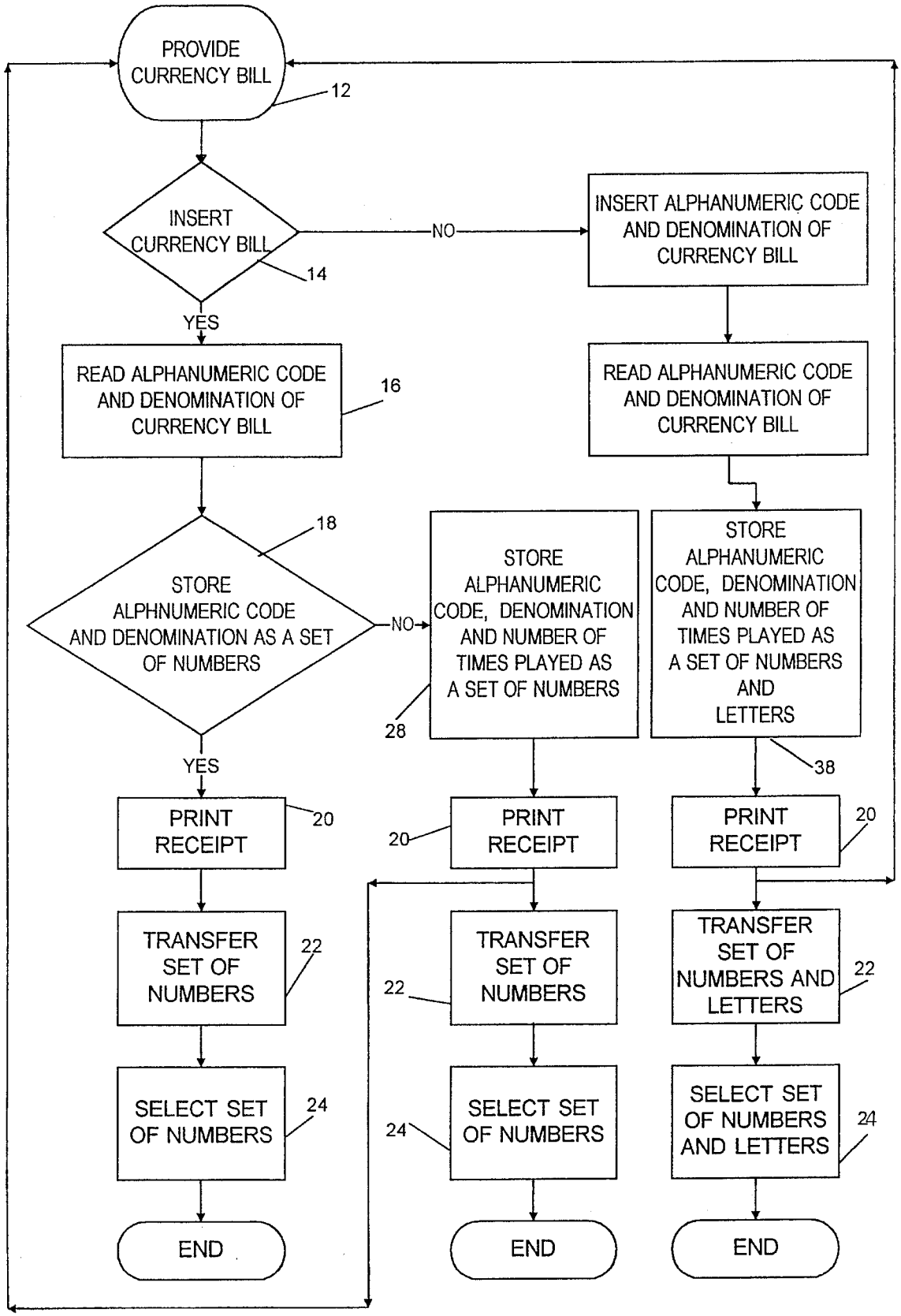
PROVIDE CURRENCY BILL
12
INSERT CURRENCY BILL
14
NO
INSERT ALPHANUMERIC CODE AND DENOMINATION OF CURRENCY BILL
YES
READ ALPHANUMERIC CODE AND DENOMINATION OF CURRENCY BILL
16
READ ALPHANUMERIC CODE AND DENOMINATION OF CURRENCY BILL
18
STORE ALPHNUMERIC CODE AND DENOMINATION AS A SET OF NUMBERS
NO
STORE ALPHANUMERIC CODE, DENOMINATION AND NUMBER OF TIMES PLAYED AS A SET OF NUMBERS
28
STORE ALPHANUMERIC CODE, DENOMINATION AND NUMBER OF TIMES PLAYED AS A SET OF NUMBERS AND LETTERS
38
YES
PRINT RECEIPT
20
PRINT RECEIPT
20
PRINT RECEIPT
20
TRANSFER SET OF NUMBERS
22
TRANSFER SET OF NUMBERS
22
TRANSFER SET OF NUMBERS AND LETTERS
22
SELECT SET OF NUMBERS
24
SELECT SET OF NUMBERS
24
SELECT SET OF NUMBERS AND LETTERS
24
END
END
END

METHOD FOR PLAYING A LOTTERY GAME USING CURRENCY BILLS

BACKGROUND OF THE INVENTION

1. Field of the Invention

The present invention relates in general to a lottery games and, in particular, to a method of playing a lottery game without using or marking lottery tickets or game cards or betting slips or selecting a set or series of numbers.

2. Description of the Prior Art

Various methods of playing lottery games are known in the prior art. A typical example is found in U.S. Pat. No. 5,110,129, issued to M. G. Alvarez on May 5, 1992. This patent discloses an apparatus and a method of playing a lottery game which utilizes a lottery ticket that a ticketholder must purchase and use to select a set of lottery numbers. U.S. Pat. No. 5,156,397, issued to S. W. Valenza discloses an apparatus for use in playing a lottery game in which the apparatus is used for automated marking of a betting slip. A customer must purchase the betting slip and select a set of lottery numbers. Another example of the prior art is U.S. Pat. No. 5,340,119, issued to S. Goldfarb, which discloses a method for playing games of chance from a remote location by sending by facsimile transmission the set of lottery numbers chosen to a central location. Again, the player must select a set of numbers and send by facsimile transmission a game card or lottery ticket in to a central location. The cost of playing the set of lottery numbers is charged to the player's facsimile number. U.S. Pat. Nos. 5,232,221 and 5,116,049, issued to Sludikoff et. al., disclose a method for playing a lottery game in which the player must purchase a special lottery ticket and select the set of lottery numbers desired. U.S. Pat. No. 5,106,089, issued to M. W. Wood, discloses a method for playing a lottery game in which the player must purchase a special lottery ticket and select the set of lottery numbers desired.

All of the prior art patents require the use a lottery ticket or game card or betting slip. Printing up and selling lottery tickets adds to the cost of running a lottery game, thereby decreasing the profitability of the lottery game. Thus, a need exists for a method of playing a lottery game that does not require the use of a lottery ticket or game card or betting slip.

Furthermore, all of the prior art patents mentioned above require the player to select, with or without the aid of a machine, a set of lottery numbers desired. Requiring the player to select his or her own set of lottery numbers can result in player errors. Thus, a need exists for a method of playing a lottery game which reduces or eliminates player error resulting from the player choosing his or her own set of lottery numbers.

For the foregoing reasons, there is a need for a method of playing a lottery game which does not require the use of a lottery ticket or game card or betting slip or selecting a set or series of numbers, the lottery ticket and selection process tending to decrease the profitability of the lottery game and increase player error in obtaining a set of lottery numbers. The present invention substantially overcomes these and other prior art problems.

SUMMARY OF THE PRESENT INVENTION

The preferred embodiment of the method of the present invention solves the aforementioned problems in a straightforward and simple manner. An object of the present invention is to provide an improved method of playing a lottery game which does not require the use of a lottery ticket or game card or betting slip.

Another object of the present invention is to provide a faster and more convenient method of playing a lottery game.

Another object of the present invention is to provide a method of playing a lottery game that is more profitable than the current methods of playing a lottery game.

Another object of the present invention is to provide a more accessible and user-friendly method of playing a lottery game.

Another object of the present invention is to provide a method of playing a lottery game which may operate on existing on-line equipment by applying minor modifications and/or upgrading.

Still another object of the present invention is to provide a method of playing a lottery game which includes a multiplicity of games with different odds and prize structures.

The present invention is directed to a method of playing a lottery game without the use of a lottery ticket. The method requires a currency bill or bank note bearing an alphanumeric code, such as a serial number, and denomination. The currency bill or bank note is inserted into a locally situated machine which reads the alphanumeric code and denomination of the currency bill or bank note. (Alternatively, this information can be entered manually by a lottery agent, such as the retailer who is licensed to operate the machine.) The locally situated machine then stores the alphanumeric code and denomination of the currency bill or bank note as a set of numbers in the machine's memory. The machine then prints out a receipt bearing the alphanumeric code and denomination of the currency bill or bank note along with the day of drawing of the lottery game being played. The set of numbers stored in the locally situated machine's memory is then transferred to a remotely located main computer's central memory. The computer then randomly selects (by running an appropriate software program) a set or series of numbers from among the sets or series of numbers transferred to the computer. The selected set of numbers wins the lottery game. The selection of winning numbers can be for one or more sets (e.g., first prize, second prize, third prize).

In a preferred embodiment of the present invention, the main computer stores the number of times the currency bill or bank note has been inserted into all locally situated machines, along with the alphanumeric code and denomination of the currency bill or bank note, as a set of numbers.

In the most preferred embodiment of the present invention, the computer stores the alphanumeric code and denomination of the currency bill or bank note, along with the number of times the currency bill or bank note has been inserted into all locally situated machines, as a set of numbers and letters.

In the present invention, it is important to understand that any bill can be played numerous times since currency changes hands. For example, a person could play a bill on one locally situated machine in Pensacola, Fla., one day; the bill can reenter the stream of commerce and find its way to Miami, Fla., where someone else can then play the same bill on a second locally situated machine in Miami the next day (both players will have a receipt).

These and other features, aspects, and advantages of the present invention will become better understood with regard to the following description, and appended claims.

BRIEF DESCRIPTION OF THE DRAWING

The sole drawing FIGURE is a flow chart depicting the steps according to the method of the present invention.

DETAILED DESCRIPTION OF THE PREFERRED EMBODIMENT

The present invention is directed to a method of playing a lottery game in which the players' wagers are placed in a common pool and selectively divided among them in accordance with their own selections and the rules of the game.

The present invention comprises a method of playing a lottery game without the use of a lottery ticket or game card or betting slip. The method, depicted in the FIGURE, requires 12 a currency bill or bank note (such as a U.S. dollar bill) bearing an alphanumeric code, such as a serial number, and denomination. The currency bill or bank note is inserted 14 into one of many machines, located throughout the lottery's geographic area, which reads 16 the alphanumeric code and denomination of the currency bill or bank note. Preferably, the locally situated machines contain a computer with a memory and a printer. The machines store 18 the alphanumeric code and denomination of the currency bill or bank note as a set of numbers in memory. For example, a one dollar ($1.00) bill having a serial number of "I86785237F" might be stored as "09.86785237.06.001": where "09" represents the letter "I"; "86785237" represents "86785237"; "06" represents the letter "F"; and "001" represents the denomination of the currency bill, one dollar. The local machine being used then prints 20 a receipt or ticket bearing the alphanumeric code and denomination of the currency bill or bank note and the day of the "drawing" for the lottery game being played. The set of numbers is then electronically transferred 22 from the local machine to a main computer's central memory. Preferably, the main computer possesses a database for storing the set of numbers and software for randomly selecting a set or series (or sets or series) of numbers from the database. Even more preferably, the present invention uses existing on-line equipment to store the set of numbers and randomly select a set or series of numbers. The main computer then randomly selects 24 a set or series of numbers from among the sets of numbers transferred to the main computer. The set of numbers selected wins the lottery game. (Again, several sets can be selected for various prizes, i.e., first, second and third prizes).

In a preferred embodiment of the present invention, the central computer stores 28 the number of times any particular currency bill or bank note has been inserted 14 into the locally situated machines, along with the alphanumeric code and denomination of the currency bill or bank note, as a set of numbers. Using the example stated above and assuming the currency bill has only been inserted 14 into a machine once, the set of numbers might be stored as "09.86785237.06.001.01": where all of the above digits represent the same things, discussed in the example above, and the "01" at the end represents the number of times the currency bill has been inserted into any locally situated machine, namely once. If the same bill were to be played three (3) times, the stored number would read 09.86785237.06.001.03 and if it were the winning set of numbers the prize would be divided three ways.

In the most preferred embodiment of the present invention, the main computer stores 38 the alphanumeric code and denomination of the currency bill or bank note, along with the number of times the currency bill or bank note has been inserted into locally situated machines, as a set of numbers and letters. Using the above example described in the previous paragraph, the set of numbers and letters might be stored 38 as "09.86785237.06,001.AA": where all of the above digits represent the same thing, and "AA" represents that the currency bill has been inserted into a machine only once.

As can be seen from the above description, the present invention does not require a lottery ticket or game card or betting slip. Thus, the present invention provides a more profitable method of playing a lottery game because the cost of printing and selling lottery tickets is saved. Furthermore, the present invention provides a faster and more convenient method of playing a lottery game because a player does not have to select any lottery numbers or purchase a lottery ticket; he need only insert 14 a currency bill or bank note into a locally situated machine. This advantage of the present invention also makes playing the lottery game more accessible and user-friendly for players of the lottery game. In addition, because a player does not have to select any lottery numbers or fill in any lottery tickets, the risk of player error is reduced and/or eliminated.

The present invention does not require the range of lottery numbers to be limited. For example, the Florida Lotto lottery game foresees 6 numbers to be picked within a range from 1 to 49. The present invention does not require any combination of numbers to be played, further distinguishing the present invention from the prior art.

The present invention also contemplates a method of playing a lottery game in which a multiplicity of games with different odds and prize structures.

The present invention further contemplates that the other aspects of the method of playing a lottery game, such as administration rules, legal aspects, complying with state and federal laws, definition of ticket expiration, advertisement, training of retailers, installation of lottery ticket vending machines, parting or prizes, saving of data from previous drawings, etc., are deemed readily apparent and obvious to one skilled in the art, and that all equivalent relationships to those described in the specification are intended to be encompassed by the present invention.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method of playing a lottery game comprising the steps of:

(a) providing a currency bill bearing an alphanumeric code and denomination;

(b) inserting said currency bill into a means for reading the alphanumeric code and denomination of said currency bill;

(c) reading the alphanumeric code and denomination of said currency bill with said reading means of said inserting step;

(d) storing the alphanumeric code and denomination of said currency bill as a set of numbers in a means for storing;

(e) printing a receipt which bears said alphanumeric code and denomination of the currency bill inserted into said reading means with a means for printing a receipt;

(f) transferring the set of numbers from the storing means of said storing step to a means for randomly selecting a set of numbers; and (g) randomly selecting a set of numbers from said transferred set of numbers in said selecting means of said transferring step, such that said set of numbers selected is the winning set of lottery numbers.

2. The method as recited in claim 1, wherein said storing step (d) further comprises: storing the number of times said currency bill has been inserted into said reading means, along with the alphanumeric code and denomination of said currency bill, as a set of numbers.

3. The method as recited in claim 2, wherein:

(a) said storing step (d) stores the number of times said currency bill has been played, along with the alphanumeric code and denomination of said currency bill, as a set of numbers and letters;

(b) said transferring step (f) transfers said set of numbers and letters to said selecting means; and, (c) said randomly selecting step (g) randomly selects a set of numbers and letters, such that the selected set of numbers and letters is the winning set of lottery numbers and letters.

4. A method of playing a lottery game comprising the steps of:

(a) providing a currency bill bearing an alphanumeric code and currency denomination;

(b) inserting said currency bill into electronic means for reading the alphanumeric code and denomination of said currency bill;

(c) reading the alphanumeric code and denomination of said currency bill with said reading means of said inserting step;

(d) storing the alphanumeric code and denomination of said currency bill as a set of numbers in electronic means for storing;

(e) transferring the set of numbers from said storing means of said storing step to electronic means for randomly selecting a set of numbers;

(f) printing a receipt which bears said alphanumeric code and denomination of the currency bill inserted into said reading means with a means for printing a receipt; and, (g) randomly selecting a set of numbers from said transferred set of numbers in said selecting means of said transferring step, such that said set of numbers selected is the winning set of lottery numbers.

5. The method as recited in claim 4, wherein said storing step (d) further comprises: storing the number of times said currency bill has been inserted into said reading means, along with the alphanumeric code and denomination of said currency bill, as a set of numbers.

6. The method as recited in claim 5, wherein:

(a) said storing step (d) stores the number of times said currency bill has been played, along with the alphanumeric code and denomination of said currency bill, as a set of numbers and letters;

(b) said transferring step (e) transfers said set of numbers and letters to said selecting means; and, (c) said randomly selecting step (g) randomly selects a set of numbers and letters, such that the selected set of numbers and letters is the winning set of lottery numbers and letters.

7. A method of playing a lottery game comprising the steps of:

(a) providing a currency bill bearing an alphanumeric code and currency denomination;

(b) inserting the alphanumeric code and denomination of said currency bill into one of remotely situated means for reading the alphanumeric code and denomination of said currency bill;

(c) reading the alphanumeric code and denomination of said currency bill with said reading means of said inserting step;

(d) storing the alphanumeric code and denomination of said currency bill as a set of numbers in a means for storing connected to said one of said remotely situated reading means;

(e) printing a receipt which bears said alphanumeric code and denomination of the currency bill inserted into said reading means with a means for printing a receipt;

(f) transferring the set of numbers from the storing means of said storing step to one centrally located means for randomly selecting a set of numbers; and (g) randomly selecting a set of numbers from said transferred set of numbers in said selecting means of said transferring step, such that said set of numbers selected is the winning set of lottery numbers.

8. The method as recited in claim 7, wherein said storing step (d) further comprises: storing the number of times said currency bill has been inserted into said reading means, along with the alphanumeric code and denomination of said currency bill, as a set of numbers.

9. The method as recited in claim 8, wherein:

(a) said storing step (d) stores the number of times said currency bill has been played, along with the alphanumeric code and denomination of said currency bill, as a set of numbers and letters;

(b) said transferring step (f) transfers said set of numbers and letters to said selecting means; and, (c) said randomly selecting step (g) randomly selects a set of numbers and letters, such that the selected set of numbers and letters is the winning set of lottery numbers and letters.

* * * * *